United States Patent [19]

Larson

[11] 4,024,787

[45] May 24, 1977

[54] FOOT OPERATED MUSICAL INSTRUMENT

[76] Inventor: Harold W. Larson, 1204 - 26th St., Fort Madison, Iowa 52627

[22] Filed: Dec. 29, 1975

[21] Appl. No.: 644,851

[52] U.S. Cl. ..... 84/1.16; 84/173; 84/327; 84/455; 84/DIG. 30

[51] Int. Cl.[2] ..... G10D 1/00; G10H 3/02

[58] Field of Search ..... 84/1.04, 1.06, 1.14–1.16, 84/7, 173, 267–269, 284, 285, 327, 455, DIG. 30; 248/443

[56] References Cited

UNITED STATES PATENTS

| | | | |
|---|---|---|---|
| 1,988,220 | 1/1935 | Siegrist | 84/173 |
| 2,914,982 | 12/1959 | Bossier | 84/267 X |
| 3,197,542 | 7/1965 | Appleton | 84/1.15 |
| 3,320,844 | 5/1967 | Lostimolo | 84/173 |
| 3,407,697 | 10/1968 | Jackson | 84/1.16 X |
| 3,510,566 | 5/1970 | McKenzie | 84/1.16 |
| 3,603,192 | 9/1971 | Kaar | 84/173 |
| 3,693,491 | 9/1972 | Creager | 84/1.04 X |
| 3,758,696 | 9/1973 | Miller | 84/1.16 |

*Primary Examiner*—Stanley J. Witkowski
*Attorney, Agent, or Firm*—Thomas E. Frantz

[57] ABSTRACT

A floor mounted electric bass instrument which generates a musical signal in response to depression of one of its strings against an appropriate fret. The instrument is compact, yet it provides structure for spacing the strings a substantial distance apart to permit quick and convenient selection and depression of a desired string by a relatively large or blunt portion of the musician's foot while avoiding operative contact with adjacent strings.

11 Claims, 3 Drawing Figures

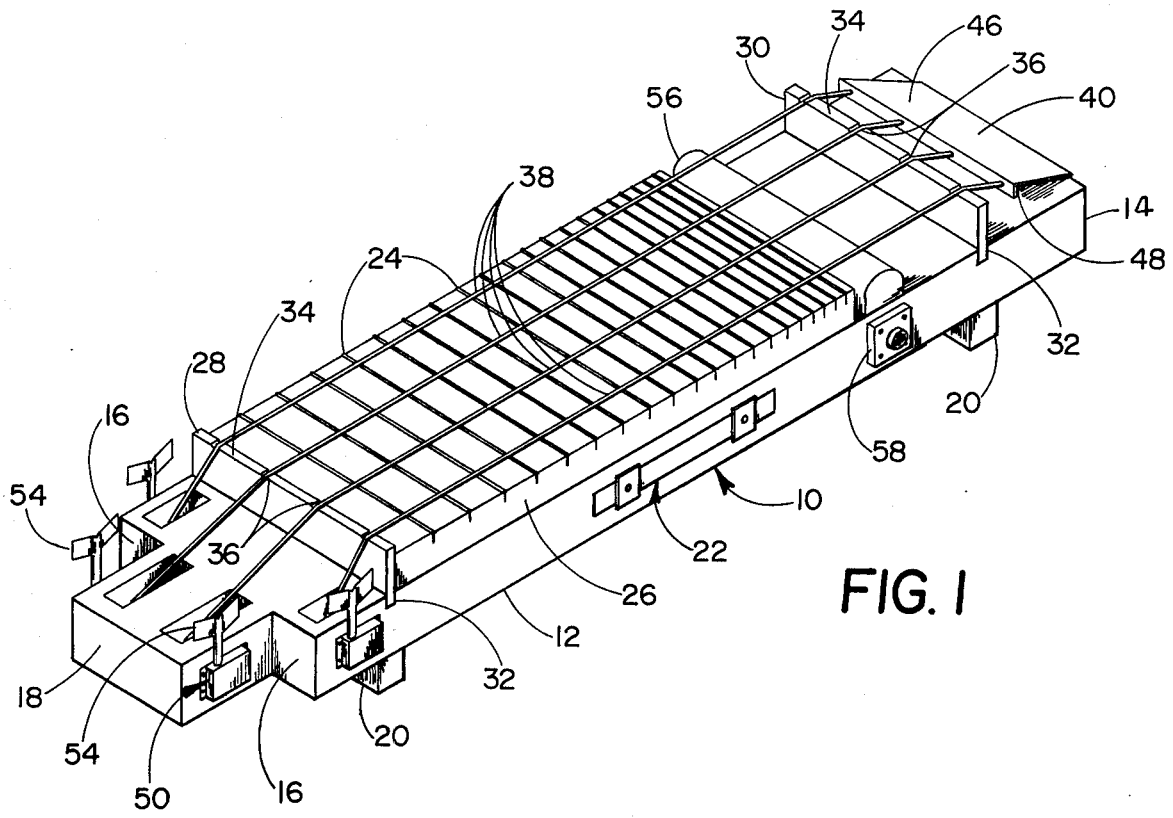
FIG. 1
FIG. 2
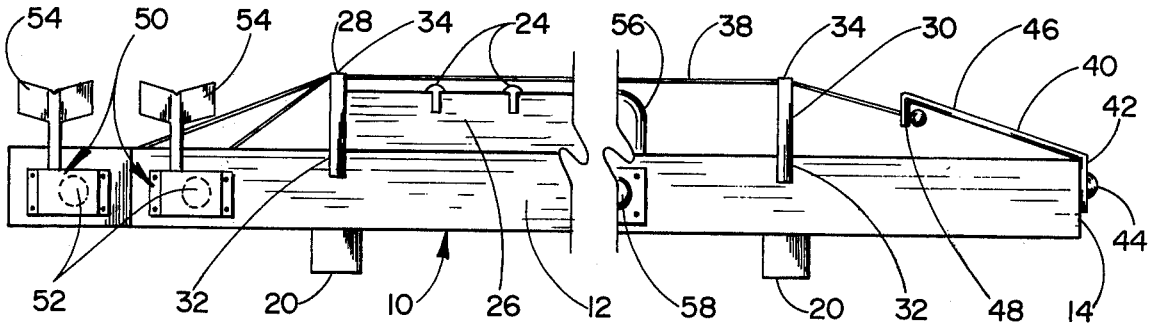
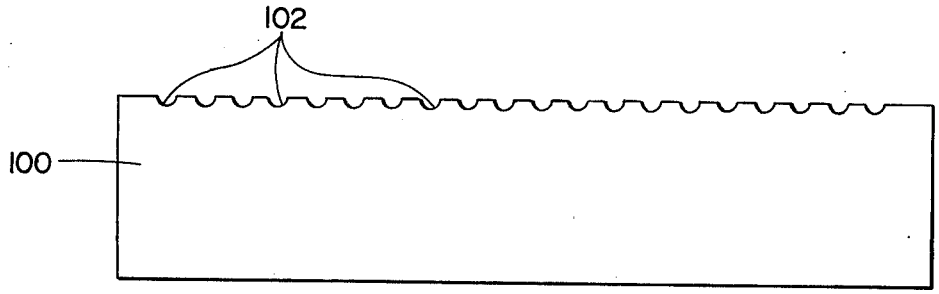
FIG. 3

FOOT OPERATED MUSICAL INSTRUMENT

BACKGROUND OF THE INVENTION

This invention relates generally to a stringed musical instrument and more particularly to a floor mounted electric bass adapted to be operated by use of one foot.

In the larger lounges and nightclubs, entertainment generally is provided by a band or musical group having several musicians, each playing an individual instrument to provide a "full" or composite lead/rhythm sound. Small clubs and lounges, however, can neither afford nor provide space for such multimember bands. Thus, if "live" entertainment is desired in the smaller lounges, it generally is provided by a single musician who both sings and accompanies himself on a lead guitar or similar hand held/played instrument.

Such solo musicians may use an electric drumming device in an effort to simulate the sound and rhythm provided by the live drummer of a larger band. However, even where such an electric drummer is used, the sound or effect of a single musical instrument generally is somewhat "shallow" or "hollow."

In an effort to overcome this "shallow" sound, it has been proposed in the past to provide a floor mounted bass or similar instrument designed for operation by use of one or both feet of a musician while he simultaneously operates a hand held/played instrument. Unfortunately, such prior attempts to provide a floor mounted, foot operated instrument have met with little or no success. They have resulted in instruments which are too expensive for the average musician to purchase and maintain; too complex for the average musician to maintain and repair; too heavy and cumbersome to move conveniently from job to job; or too difficult or complicated to operate by a foot. At best, a foot is not easily manipulated even if the mind of the musician should not be otherwise occupied in playing a hand held guitar and perhaps simultaneously singing lyrics.

SUMMARY OF THE INVENTION

This invention is directed to a compact, generally rectangular floor mounted musical instrument having a plurality of strings which are spaced from one another such that even by using a relatively large or blunt portion of his foot, an individual playing the instrument can conveniently select and depress a particular string against a desired fret to produce a musical note without danger of operatively depressing adjacent strings. The strings are tensioned in a flat plane spaced above a set of frets which are carried by a compact, sturdily built base made of any one of several rigid non-magnetic materials and resonately isolated from the floor. The strings are positioned by two support members spaced apart on the base outwardly of the frets, the supports including axially aligned grooves in which opposite ends of the strings are operatively held by tensioning means carried by the base outwardly of the support members. In one embodiment, the support members include a greater number of grooves than the number of strings employed with the instrument whereby the spacing of the strings may be varied by the user.

Accordingly, it is an object of the invention to provide an improved bass instrument of the floor mounted type.

Another object of this invention is the provision of an electric bass instrument which can be easily, conveniently and accurately played by simple and natural movements of one foot of the user while in a seated position.

Yet another object of this invention is to provide a floor mounted electric bass instrument having structure for positioning the strings such that one string is selectively depressible by a relatively large or blunt portion of the user's foot without danger of operatively depressing adjacent strings.

A still further object of this invention is to provide a foot operated electric bass in which the positioning of the strings is selectively variable by the user to permit adaption of the instrument to the manner of playing which best suits that user.

Another object of this invention is to provide a foot operated bass constructed and operated in such manner that the average guitar, bass or banjo player can easily and quickly learn to play it using his existing knowledge and ability.

Still further, it is an object of this invention to provide a foot operated bass which can be constructed inexpensively yet ruggedly, which is compact and easily transported, which is easily and conveniently played, and which can be adapted readily to the varying requirements of individual users.

Yet additional objects and features of this invention will be apparent from the following specification and claims when considered in connection with the accompanying drawings.

DESCRIPTION OF THE DRAWINGS

FIG. 1 is a perspective view of a floor mounted bass instrument constructed in accordance with a preferred embodiment of the present invention.

FIG. 2 is an enlarged, broken side plan view of the embodiment of FIG. 1.

FIG. 3 is a front plan view of a modified form of the string supports of the type employed in the embodiment of FIG. 1.

DESCRIPTION OF THE PREFERRED EMBODIMENT

Referring first to FIG. 1, it will be seen that the preferred embodiment of the present invention consists of a compact floor mounted bass guitar or instrument 10, having an elongate base 12 of a generally rectangular parallelepiped configuration. Any one of a number of rigid, non-magnetic materials may be used in constructing base 12, such as aluminum or other non-ferrous metals, molded synthetic resins of high impact resistance, fiberglass reinforced plastics, and the like. In the present embodiment, however, wood is preferred as it is readily available, easily fabricated with common woodworking equipment, and conveniently finished to provide an attractive appearance.

For reasons which will be readily understood by those in the art, the wood used in fabricating base 12 should be knot free, and have a low coefficient of linear expansion when subjected to changes in temperature and/or humdity, high resistance to deformation under continuous stress and a relatively close grained dense cellular structure. Such readily available hard woods as birch, maple, beech and mahogany are representative of several wood types which are suited for this purpose. Softer woods may be used, of course, but in this event the musician would probably find it necessary to retune the guitar more often than with instruments having a base made of a dimensionally stable hard wood.

One end of the base 12 is cut perpendicularly to its longitudinal axis to provide a flat end surface 14. The other end preferably is reduced in width as by notches 16, to provide a centrally located extension 18. Because of its generally rectangular shape, incidentally, the instrument 10 can be provided with a simple and inexpensive rigid cover (not shown) to protect its strings, pick up head, tuning heads, etc., thereby eliminating the need for the usual expensive case for protection during movement or storage.

As best shown in FIG. 2, the instrument 10 is spaced above and resonately isolated from the floor by supporting means consisting of a plurality of resilient feet 20. These feet 20 may be formed of any suitable elements, such as coil springs or resilient rubber plugs or strips, and may be arranged on and attached to the bottom surface of base 12 in any suitable manner. Particularly when the bass 10 is placed on a wooden floor or platform, feet 20 will prevent transmission to the instrument of vibrations which may be created in the floor in response to dancing, walking, foot tapping, etc. Also, feet 20 will help to resist inadvertent shifting of the bass should it be bumped or pushed lightly while being played.

A handle assembly 22 may be provided on one side of base 12 to permit easy portability of the instrument from place to place.

Disposed on the upper surface of base 12 intermediate its ends 14 and 18, are a plurality of relatively long frets 24 which are positioned transversely of and spaced from one another along the longitudinal axis of the base. As will be understood, the frets are (1) spaced a distance which is of conventional bass fret spacing and (2) aligned so that their upper surfaces lie in a flat plane disposed in a substantially parallel relationship with the upper surface of base 12.

The frets 24 preferably are supported by means of a fret board 26 having a generally rectangular parallelepiped configuration of a width substantially equal to that of base 12. Conventional wood screws, adhesive or any other convenient securing arrangement may be employed in securing fret board 26 intermediate the ends of base 12. As with base 12, any one of a number of non-magnetic materials may be used in fabricating fret board 26, but for the reasons previously given, wood is preferred.

As will be clear to those in the art, the use of a separate fret board 26 is not essential in constructing a bass according to the present invention; the board may be formed as an integral portion of base 12 or the frets may be mounted directly on the base.

Two string support or spacing members 28 and 30 are disposed on base 12 outwardly of the ends of fret board 26. For convenient identification these two members sometimes will be referred to hereinafter as the nut 28 and bridge 30. It is to be understood, however, that for convenient manufacture, these two members preferably are substantially identical in dimensions, configuration and method of mounting on base 12.

As will be noted from FIG. 1, the string supports 28 and 30 are relatively thin rectangular members disposed transversely of the longitudinal axis of base 12 generally parallel with and of about the same length as frets 24. Other mounting arrangements obviously may be used, but in the illustrated embodiment, the base 12 is provided with transverse grooves 32 sized to frictionally receive the lower edge of and support the members 28 and 30 in a perpendicular relationship with base 12. The straight upper edge or surface 34 of each member is provided with a set of channels 36 which are spaced relatively evenly along the edge and preferably formed as grooves in which the strings 38 are easily placed and securely retained.

One of the support members or nut 28 is disposed close to or contiguous with one end of the fret board 26, with the other member or bridge 30 being spaced some distance from the other ebnd of the board 26. Since the bridge and nut are substantially identical, the grooves 36 in one support, of course, will be aligned with the grooves 36 in the other support.

The four strings 38 are conventional metallic bass strings. At one end the strings 38 are supported in and spaced by the grooves 36 of nut 28, and at the other end they are supportedly spaced by grooves 36 of bridge 30. For the reasons which will be discussed in greater detail herebelow, the grooves 36 and hence the strings 38 are spaced apart a distance of not less than about 1 inch and not more than about 3 inches. For a majority of musicians playing the instrument 10, however, a string spacing of about one and one half inch would be found satisfactory.

Outwardly of bridge 30 is a tail piece 40 formed of sheet metal and provided with a mounting portion 42 attached to flat end 14 of base 12 by a plurality of screws 44, or the like. Angled from mounting portion 42 toward bridge 30 is an intermediate section 46 which terminates in an offset end 48 to which one end of the strings 38 are removably coupled or attached. Tail piece 40 thus serves as means for anchoring one end of the strings 38 relative to base 12 and frets 24.

Adjacent the other end of base 12 outwardly of nut 28 are a plurality of conventional tuning heads 50. Each head includes a drum portion 52 journaled for rotation about an axis disposed perpendicular to one of the strings 38, the end of which is releasably connected to the drum portion. A key portion 54, operatively engaged with drum 52, extends upwardly from base 12 to a position where it is easily grasped by the user when the bass 10 is disposed on the floor in playing position. As will be understood by those in the art, manual rotation of key portion 54 will cause concomitant rotation of drum portion 52 to wind string 38 onto the drum until the string is properly tensioned between nut 28 and bridge 30.

As will be obvious from FIG. 1 of the drawing, notches 16 are formed in base 12 whereby reduced extension 18 will be of a width necessary to accept tuning heads for the two interior strings 38. The other two tuning heads are mounted forwardly and outwardly of extension 18 to accept the two outer strings 38.

Disposed on base 12 between fret board 26 and bridge 30 is a conventional magnetic pickup means 56 to which an output jack 58 is electrically connected. The pickup means 56, of course, senses vibrations in strings 38 when they are played, and converts these vibrations into electrical signals which are fed to output jack 58 for transmission to a suitable amplifier.

In readying the instrument for use, the cover, if any, is removed, and the guitar placed on its feet 20 on the floor of the room, platform or area in which the musician is to perform. The precise position of the bass relative to the musician's chair or stool will depend upon the foot and the foot motion to be used in its operation. Assuming, however, that the bass will be played with the right foot, it preferably should be placed slightly ahead of and to the right of the chair, with its longitudinal axis disposed approximately at right angles relative to the upper leg of the seated musician. Thus, by use of a simple swinging motion of his leg, the musician will be able to move his foot axially along the full length of the fret board 26 to depress a given string 38 agaisnt any of the frets 24. Simultaneously with such swinging motion, a simple flexure of the knee will provide transverse movement of the musician's foot relative to the fret board to change from one string to another.

Different musicians, of course, may use different positions of the foot to contact and depress a string for playing purposes. Also, in some cases a musician may play the instrument with his shoe on, while others will remove the shoe and use a portion of his stockinged foot. In any event, however, it has been found preferable to use the outer or distal end of the foot rather than the heel because of the ease with which a string can be depressed by a simple downward movement of the distal end. In this connection, if the shoe has been removed, either the ball of the foot or the bottom of the large toe has been found quite suited for use in depressing the strings 38 for playing purposes. Or, should the musician wish to provide a more sophisticated or advanced rythm, the relatively wide spacing of strings 38 will permit simultaneous contact with two strings; one with the ball of the foot and the other with the ball of the big toe. The average musician, however, generally will find use of one string satisfactory for most purposes.

In playing the bass 10, a particular string 38 is contacted and depressed by the foot of the musician against a given fret 24 to produce the note desired. Contact between the string and fret will create vibrations in the string over the pickup head 56 which senses such vibrations and converts them into electrical signals which are fed to output jack 58 through a co-axial cable (not shown). As will be readily understood by those in the art, the electrical signals are then picked up at output jack 58 by a suitable plug attached to a flexible co-axial cable which is plugged into or otherwise connected to an amplification system.

Particularly if the musician should prefer to play the bass 10 while wearing his shoe, the above mentioned string spacing of about one and one half inch may not be adequate to permit operative depression of one string without inadvertent operative depression of an adjacent string. In this event, the spacing between strings should be increased. Such an increase can be accomplished simply by increasing the spacing between the grooves 36 in nut 28 and bridge 30 at the time these support members are fabricated.

Alternatively, the bass may be provided with a bridge and nut which will permit "on-the-spot" variations in the spacing of the strings 38 by the musician. In this connection, attention is called to FIG. 3, wherein there is illustrated a modified support or spacing member 100. This modified support is similar to previously described support members 28 – 30, except that instead of having the same number of grooves as strings, it includes a multiplicity of closely spaced grooves 102 formed along substantially the complete length of its top edge. As will be obvious, employment of two supports 100 in place of the nut 28 and bridge 30 of the embodiment of FIGS. 1 and 2, will permit rapid and convenient changes in the spacing between strings 38. Such changes may be effected simply by rotating keys 54 to loosen the tension of the strings, manually moving the ends of each string to appropriate grooves 102, and then re-tensioning the strings.

While this invention does not involve the structure or function of pickup head 56, it will be understood by those in the art that included in the head is an individual magnetic member centered below each of the strings 38. Thus, depression of a string causes it to vibrate through or disturb the flux lines radiating from the magnetic member substantially at their zenith or high point. Since these flux lines are generally elliptical, transverse movement of the string away from the center of the magnetic member will cause it to disrupt fewer flux lines upon depression, and thus produce a softer or weaker amplified note, all other factors remaining constant.

In prior art instruments, the above described "softening" effect could not be utilized, the positioning of the strings being fixed. In an instrument provided with modified support members 100, however, any desired string 38 may be "softened" relative to the balance of the strings merely by moving it transversely to an "off center" position in appropriate grooves 102.

Depending upon the amount of transverse movement found necessary in adapting the positioning of strings 38 for use by a musician, one or more of the strings may be too far "off center" relative to the accompanying magnetic member to operate properly. Thus, if it is anticipated that the strings may be moved a relatively large distance in an instrument having supports 100, the magnetic members of the pickup head 56 should either be relatively long or mounted individually to permit selective re-positioning by the musician after placement of strings 38.

As will be appreciated from the above description, this invention is directed to a foot operated electric bass which is very simple and inexpensive to fabricate, is compact and rugged, is easily transported and set up for use, is played in a manner which is quickly and easily mastered by most musicians, and is easily and conveniently played by a comfortable swinging movement of the leg in combination with what might be compared to a "tapping" movement of the foot.

It is to be understood that although the appended drawings and preceding description of the preferred embodiment are relatively detailed, they are for the purpose of illustration only and are not to be taken as limiting the present invention, the scope of which is to be defined by the following claims.

I claim:

1. A foot operated musical instrument adapted to be placed on a floor, comprising A. an elongate base, B. means for supporting said base in a spaced relation with said floor, C. a plurality of transversely disposed frets spaced axially along an intermediate portion of said base, D. a plurality of metallic strings extending longitudinally of said base, E. means for tensioning said strings in a flat plane spaced from and parallel to the top of said frets, F. means for spacing said strings transversely of one another a distance sufficient to permit manual depression of a single selected string against one of said frets in response to contact between said string and a portion of the user's foot, and G. means for picking up vibrations from said depressed string and converting said vibrations into electrical signals suitable for amplification.

2. An instrument according to claim 1, characterized by a fret board disposed intermediate the ends of said base in supporting engagement with said frets.

3. An instrument according to claim 2, characterized by said spacing means comprising A. a nut mounted proximate one end of said fret board and provided with a first set of spaced channels adapted to receive one end of said strings, and B. a bridge spaced from the other end of said fret board and provided with a second set of spaced channels aligned with said first set of channels and adapted to receive the other end of said strings.

4. An instrument according to claim 3, characterized by the feature that said channels in each of said sets are spaced apart such that the distance between adjacent strings ranges between about one inch and about three inches.

5. An instrument according to claim 4, characterized by

A. said tensioning means comprising i. a tail piece mounted on said base outwardly of said bridge, ii. a plurality of tuning heads mounted on said base outwardly of said nut, and iii. an operating key extending upwardly from each said tuning head to a position above said base for manual rotation when said instrument is disposed on said support surface in playing position, B. one end of each of said strings being releasably coupled to said tail piece and the other end releasably connected to one of said tuning heads, and C. each of said operating keys being rotatable independently of said other keys to permit selective adjustment of said tension of each said string.

6. An instrument according to claim 5, characterized by said supporting means comprising a plurality of resilient feet resiliently supporting said base in a resonately isolated relationship with said floor.

7. An instrument according to claim 6, characterized by the feature that said base and fret board are composed essentially of non-magnetic material selected from the group consisting of wood, rigid synthetic resins and non-ferrous metals.

8. An instrument according to claim 6, characterized by the feature that said base and said fret board are composed essentially of wood.

9. An instrument according to claim 8, characterized by the features that A. said elongate base is of a generally rectangular parallelepiped configuration, and B. said fret board is of a generally rectangular parallelpiped configuration of a width substantially equal to the width of but shorter in length than said base.

10. An instrument according to claim 9, characterized by

A. said nut being positioned against one end of said fret board and said channels being defined by grooved formed in the upper edge of said nut, B. said bridge being mounted on said base and said apertures being defined by grooves formed in the upper edge of said bridge, and C. said pick-up means being mounted on said base between said fret board and said bridge.

11. An instrument according to claim 4, characterized by the features that the number of said channels in each of said sets exceed the number of said strings whereby the ends of said strings are selectively movable transversely of said fret board to vary the distance between adjacent strings.

* * * * *